United States Patent [19]

Nelson et al.

[11] Patent Number: 4,997,344

[45] Date of Patent: Mar. 5, 1991

[54] ROTOR BEARING PRE-LOAD FOR A RADIAL PISTON PUMP

[75] Inventors: Roger J. Nelson, Cedar Falls; Donald J. Macdonald, Waterloo; Arlen W. Koelling, Waverly; William L. Snyder, Cedar Falls, all of Iowa

[73] Assignee: Deere & Company, Moline, Ill.

[21] Appl. No.: 394,609

[22] Filed: Aug. 14, 1989

Related U.S. Application Data

[62] Division of Ser. No. 207,347, Jun. 15, 1988, Pat. No. 4,915,595.

[51] Int. Cl.[5] ..... F04B 1/04

[52] U.S. Cl. ..... 417/273; 91/491

[58] Field of Search ..... 417/273; 91/491

[56] References Cited

U.S. PATENT DOCUMENTS

| | | | |
|---|---|---|---|
| 2,382,452 | 8/1945 | Svenson | 417/273 X |
| 2,426,100 | 8/1947 | Holden | 91/491 X |
| 2,530,337 | 11/1950 | McGogy | 91/491 X |
| 4,671,743 | 6/1987 | Frey | 417/273 X |
| 4,742,883 | 5/1988 | Duffy | 91/375 A |

*Primary Examiner*—Leonard E. Smith

[57] ABSTRACT

A radial piston pump is provided with a plurality of valve/piston cartridges. Each cartridge includes the piston and at least one of the valves connecting the piston to the inlet and outlet passages of the pump. The bearings for the main rotor are pre-loaded using a threadedly adjustable end guill. Once adjusted, the end quill is held in location by a pin or the like. The rotor itself is provided with counterweights to balance the eccentric cam surface. These features allow construction of a pump housing which is substantially a single unit, rather than two pump halves. A significant reduction in the number of machined bores also is obtained.

6 Claims, 3 Drawing Sheets

FIG. 3
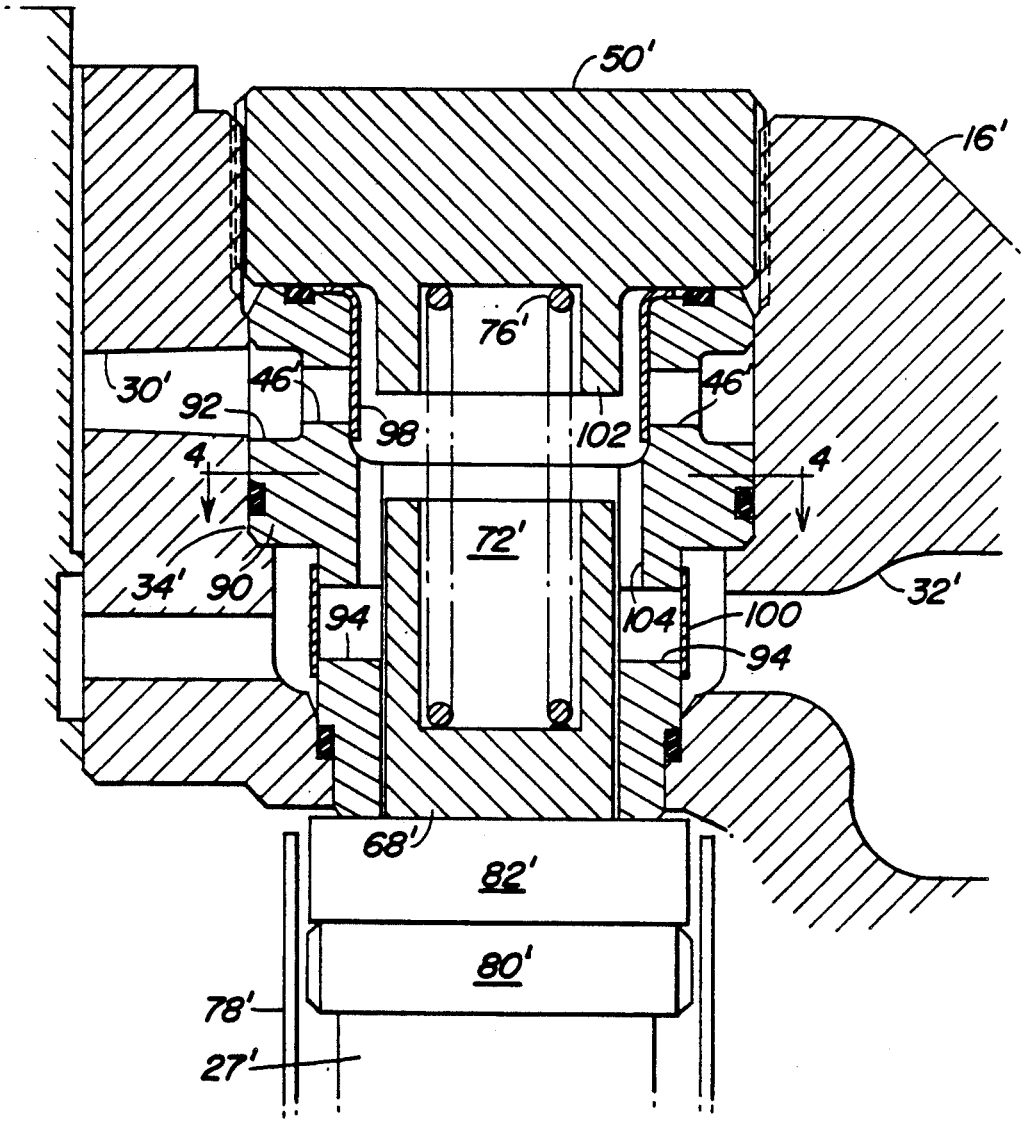
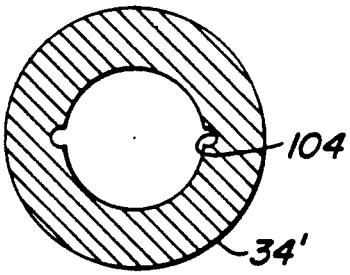
FIG. 4

ROTOR BEARING PRE-LOAD FOR A RADIAL PISTON PUMP

This application is a division of application Ser. No. 07/207,347, filed June 15, 1988 now U.S. Pat. No. 4,915,595.

BACKGROUND OF THE INVENTION

1. Field of the Invention

The present invention relates to the valve structure, rotor structure and rotor bearing pre-loading of a radial piston pump.

2. Description of the Related Art

In the typical radial piston pump, a central rotor is rotatably mounted by bearings in a housing having a plurality of circumferentially spaced piston bores radially extending from the rotor. The bearing pre-load for the rotor typically is provided by one or more shims of appropriate thickness between a cap for the housing and a race of one of the bearings. The rotor itself is provided with an eccentric cam surface at a location adjacent the radial bores. Normally, no structure is provided to compensate for the dynamic imbalance caused by the eccentricity of the cam surface.

A plurality of pistons typically is provided, with one piston in each radial bore. The pistons are spring-biased radially inwardly towards the cam surface of the rotor. Roller bearings and a race typically are provided between the cam surface and the pistons. The housing also normally is provided with an inlet valve and an outlet valve on either side of each piston bore.

As the rotor rotates, the pistons follow the cam surface, which moves them radially in and out within the radial bores. As a piston moves radially inward, hydraulic fluid is drawn into the piston bore through the inlet valve, while the outlet valve is closed. As the piston begins to move radially outward, the inlet valve closes, the outlet valve opens and the fluid is expelled.

This structure has several disadvantages. Pre-loading the rotor bearings using shims can be time-consuming and difficult. A shim must be put in place, the entire package assembled, and tested. If the shim size is incorrect, the pump must be disassembled, a new shim pack put in place, the mechanism reassembled, tested, etc.

With the typical valve structure, valves extend in through either side of the housing. This usually requires bores drilled in from either side of the housing, and, together with the bearing structure of the rotor, typically requires a two-piece housing. The entire structure requires extensive machining and assembly time, and must be made of a high grade wear-resistant material to withstand wear in the piston bores.

The typical rotor has no counterweights to compensate for the offset of the cam surface. The rotor therefore is subject to undesirable stresses when it rotates.

SUMMARY OF THE INVENTION

Accordingly, an object of the present invention is to provide a radial piston pump requiring considerably less machining and assembly time than the current variety of pump.

It is a further object of the present invention to minimize the number of discrete components required to assemble the pump according to the present invention and to provide a better balanced final product.

It is a still further object of the present invention to provide a pump the bulk of which can be formed of relatively lower grade materials.

These objects are accomplished by providing a valve/piston cartridge which incorporates at least one of the inlet and outlet valves into a cartridge with each piston. This cartridge then can easily be inserted into the piston bore. No additional valve bores are required. The valve/piston cartridge includes a liner made of a high grade wear-resistant material within which the piston slides. The pump housing then need not withstand piston friction, and can be made of relatively lower grade materials.

In addition, an end quill is threaded into the housing at the end of the main rotor to provide pre-load on the bearings. The bearing pre-load is adjusted by threading the quill into or out of the housing, and then holding it in the desired position by pins or the like. At least one counterweight is provided on the rotor to compensate for the offset cam surface. Finally, the entire housing structure may be formed as a single piece, again reducing the complexity of the pump.

BRIEF DESCRIPTION OF THE DRAWINGS

FIG. 3 is a detailed view of an alternative valve/piston cartridge incorporating both an inlet and an outlet valve therein.

FIG. 4 is a cross-sectional view of FIG. 3 along lines 4—4.

DETAILED DESCRIPTION OF THE PREFERRED EMBODIMENTS

Figure 1:
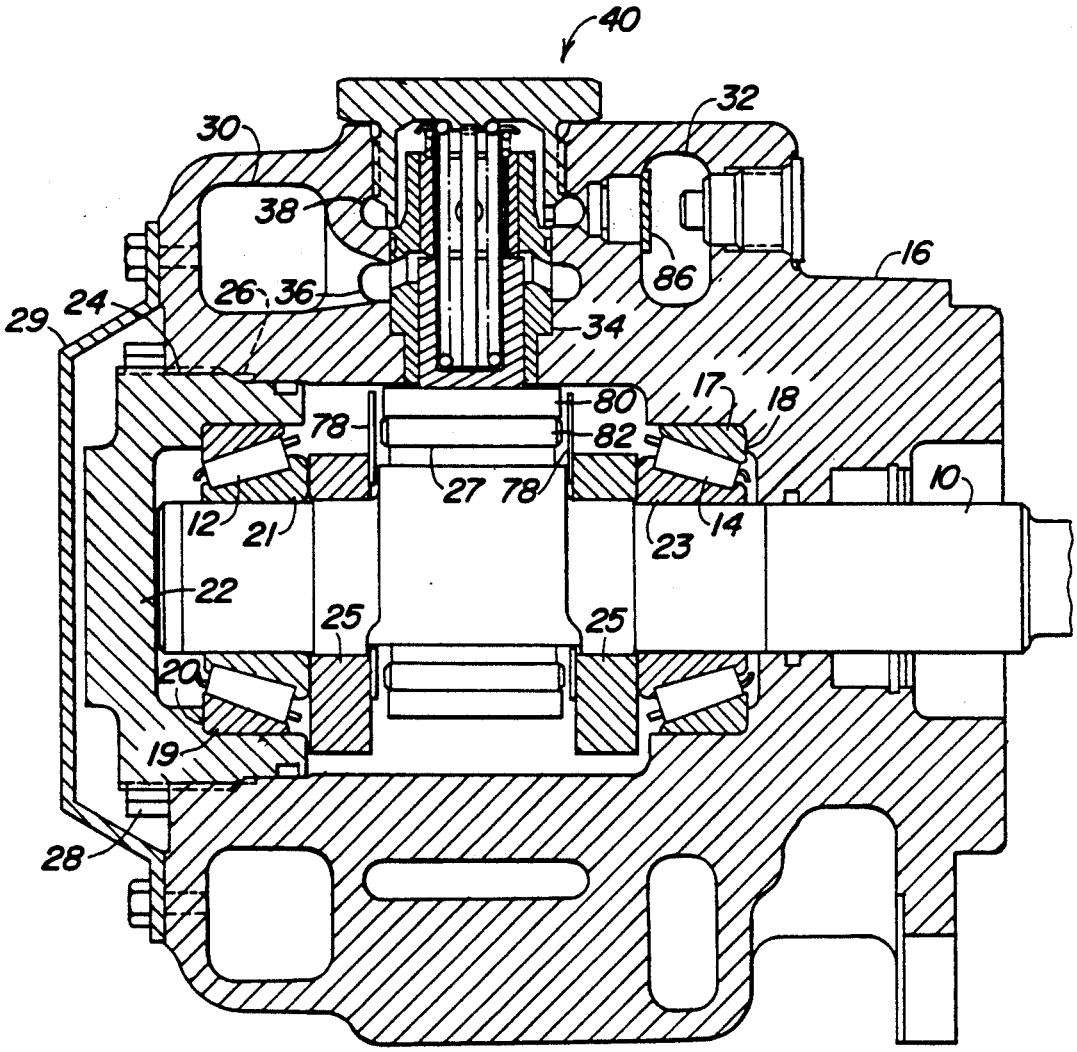
FIG. 1 depicts a cross-section of a preferred embodiment of a radial piston pump according to the present invention.

FIG. 1 illustrates a first preferred embodiment of a radial piston pump according to the present invention. A rotor 10 is rotatably mounted by bearings 12, 14 in a pump housing 16. The outer race 17 of bearing 14 is prevented from moving axially to the right as shown in FIG. 1 by a shoulder 18 formed in the pump housing 16. The outer race 19 of bearing 12 is prevented from moving axially to the left as seen in FIG. 1 by a shoulder 20 formed on the inner surface of an end quill 22. The inner races 21, 23 of the bearings 12, 14 are prevented from moving towards one another by counterweights 25 mounted on the rotor 10 on either side of the cam surface 27. Counterweights 25 also serve to counter the dynamic imbalance caused by the offset or eccentricity of cam surface 27.

The radially outer surface 24 of end quill 22 is threaded and engageable with a similarly threaded inner surface 26 of the pump housing 16. The pre-load on bearings 12, 14 thus may be adjusted simply by rotating end quill 22 to compress or decompress the bearings 12, 14. A suitable lock nut 28 or the like is provided to hold end quill 22 in the desired position. A simple cover 29 then preferably is positioned over the end quill 22 to protect it and reduce the likelihood of tampering with the bearing pre-load.

Pump housing 16 also is provided with an inlet passage 30, an outlet passage 32 and a plurality of radial valve/piston cartridge receiving bores 34 spaced circumferentially thereabout (for convenience of illustration, only one such bore 34 is illustrated). Inlet passage 30 and outlet passage 32 are connected to each bore 34 by annular grooves 36, 38 extending around the bore 34.

Figure 2:
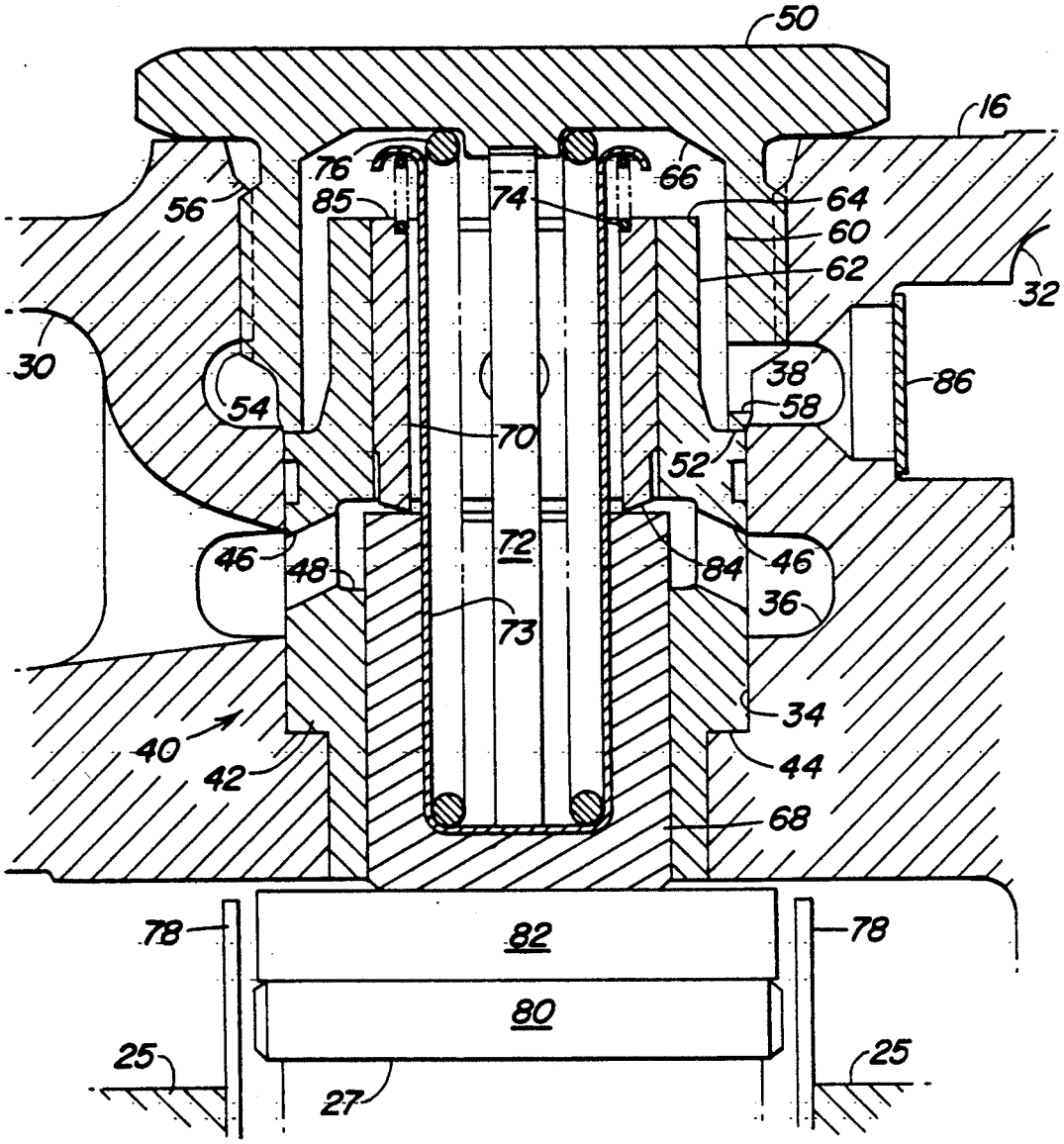
FIG. 2 is a detailed view of the valve/piston cartridge illustrated in FIG. 1.

A first preferred embodiment of a valve/piston cartridge 40 according to the present invention is positioned in each bore 34 and is best seen in FIG. 2. A hollow, substantially cylindrical liner 42 is positioned in bore 34, and preferably is formed of a wear-resistant material, e.g., high-grade steel. With the liners 42 formed of such a material, the pump housing 16 can be formed of a lower grade material, e.g., nodular iron. Radial movement of the liner 42 inward (downward in FIG. 2) is prevented by a shoulder 44 formed in the bore 34. The liner 42 has at least one (and preferably a plurality) of inlet bores 46 hydraulically connecting inlet groove 36 to the inside of the liner 42. The inner surface of the liner 42 preferably also is provided with an annular inlet groove 48 interconnecting the inlet bores 46.

The liner 42 is prevented from moving radially outward (upward in FIG. 2) by an end cap 50 which presses against a shoulder 52 formed on the liner 42. The circumferentially outer surface 54 of the end cap 50 is threaded for engagement with a similar threaded surface 56 at the top end of bore 34. At least one outlet bore 58 is provided in the end cap 50 to hydraulically connect the inside of the end cap 50 with the outlet groove 38. The inner diameter 60 of the end cap 50 is somewhat larger than the outer diameter 62 of the liner 42 in the region surrounded by the end cap 50. The outer diameter 62 of the liner 42 may be somewhat smaller in this region than elsewhere to aid in this. Similarly, the end 64 of the liner 42 stops short of the underside 66 of the end cap 50. The result of these relative spacings is to provide a hydraulic connection between the inside of the liner 42 and the outlet bore 58.

A cup-shaped piston 68 is slidably positioned inside the radially inward end of the liner 42. Similarly, hollow inlet sleeve 70 is slidably positioned inside the liner 42 radially outward from the piston 68. The space 72 between the liner 42, end cap 50, piston 68 and inlet valve sleeve 70 acts as the piston chamber of the pump, as will be described below.

A spring spider 73 extends from the base of the cup of the piston 68 to a position above the inlet valve sleeve 70, where it holds a lightweight inlet valve spring 74 which presses inlet valve sleeve 70 towards piston 68. A considerably stronger main spring 76 is positioned within the spider 73 and extends between the top cap 50 and the base of the cup of the piston 68 to bias the piston 68 towards the cam surface 27 of the rotor 10. Roller bearings 80 and a piston race 82 are provided between the cam surface 27 and the base of the piston 68. Rings 78 preferably are provided on either side of the cam surface 27 to hold the roller bearings 80 and piston race 82 in axial alignment with the cam surface 27.

The base 84 of the inlet valve sleeve 70 is angled slightly so as always to have a hydraulic connection with fluid in the inlet groove 48. The other end 85 of the inlet valve sleeve 70 is exposed to the pressure in the piston chamber 72. Finally, outlet groove 38 is connected to outlet passage 32 via a check valve 86 of any suitable type which will allow flow from the outlet groove 38 to the outlet passage 32, but not vice versa. To minimize pressure rippling in the outlet passage 32, the check valve 86 should open as easily as reasonably possible, and is shown here as a disk valve.

In operation, as the piston 68 follows the cam surface 27 radially inward from the position illustrated in FIG. 2, it creates a low pressure condition in the piston chamber 72. This closes outlet check valve 86, preventing flow of high pressure fluid from outlet passage 32 into the piston chamber 72. Pressure in the liner inlet groove 48 will match whatever pressure is in the inlet passage 30, typically atmospheric pressure. This inlet pressure will be higher than the low pressure in the piston chamber 72 and will force inlet valve sleeve 70 upwards away from piston 68. Fluid therefore will flow from the inlet passage 30 into the piston chamber 72.

When the piston 68 subsequently is forced radially outward by the cam surface 27, the pressure differences will be reversed, so that the inlet valve sleeve 70 will again engage the upper surface of the piston 68, shutting off the connection between the piston chamber 72 and the inlet passage 30. This increased pressure in the piston chamber 72 will open check valve 86, allowing the fluid in the piston chamber 72 to be forced out into the higher pressure outlet passage 32.

Note that the outer diameter of the piston 68 is greater than the outer diameter of the inlet valve sleeve 70. The outer diameter of the inlet valve sleeve 70 is the effective pumping diameter of the piston 68. In contrast, the larger outer diameter of the piston 68 is the surface that engages the piston race 82. This difference reduces the stress at the piston/piston-race interface, reducing the likelihood of a face-to-race failure.

FIGS. 3 and 4 depict an alternative embodiment of a valve/piston cartridge according to the present invention which contains both the inlet and outlet valves. For convenience, elements which perform substantially the same function as in the first preferred embodiment have been labeled with the same number and a "prime" (′), e.g., pump housing 16′, inlet passage 30′, outlet passage 32′, although their precise positions may vary from those illustrated in connection with the first preferred embodiment. These elements serve the same functions as those described in connection with the first preferred embodiment and will not be described in further detail here.

As with the first preferred embodiment, the second preferred embodiment has a liner 90 positioned in each radial bore 34′. Inlet groove 92 in the outer circumference of liner 90 serves much the same function as inlet groove 36 provided in the bore 34 of the first preferred embodiment, namely, to ensure distribution of fluid from the inlet passage 30′ around to the various inlet bores 46′.

In contrast to the first preferred embodiment, in this embodiment the end cap 50′ sealingly engages the radially outward end (upper end in FIG. 3) of the liner 90. Outlet bores 94 then are provided in the liner 90 to connect the piston chamber 72′ with the outlet passage 32′.

The actual valving operation is provided by two nearly circular flexible members 98, 100, preferably formed of spring steel or the like. The inlet flexible member 98 is provided on the piston chamber 72′ side of inlet bores 46′, while the outlet flexible member 100 is provided on the outside of outlet bores 94. Both flexible members 98, 100 preferably are prestressed to bias them to sealingly close the bores 46′, 94. The walls of the bore 34′ can serve to limit outward movement of the flexible member 100, and an annular extension 102 can be provided on the end cap 50′ to limit inward motion of the flexible member 98. This annular ring 102 also can serve to help stabilize the position of the main spring 76′.

Flexible members 98, 100 can be held positively in position, e.g., by positioning an end between two components, as illustrated with member 98 positioned between the bottom of end cap 50' and the top of liner 90. Alternatively, as illustrated with flexible member 100, they can simply be sized such that even if they move to one end or the other of the cavity in which they are located, they still will completely close their respective passages. The flexible members can be held circumferentially by any suitable means, e.g., a tang and slot arrangement or a dimple to engage the bores 46', 94.

Finally, the inner surface of the cylinder liner 90 is provided with at least one dimmple 104, best seen in FIG. 4, to provide a connection between piston chamber 72' and outlet bores 94 even when piston 68' is positioned fully within the liner 34'.

In operation, as the piston 68' follows the cam surface 27' radially inwards (downward in FIG. 3), it creates a low pressure situation in piston chamber 72'. The higher (atmospheric) pressure in inlet passage 30' forces the flexible member 98 away from inlet passages 46', allowing fluid to fill the piston chamber 72'. Meanwhile, the still higher pressure in outlet passage 32' forces flexible member 100 against liner 34', sealing off outlet bores 94.

When the piston 68' subsequently is forced radially outward (upward in FIG. 3) by the cam surface 27', a high pressure situation is created in piston chamber 72'. This forces flexible member 98 against cylinder liner 34', closing off inlet bores 46'. This pressure also forces flexible member 100 away from cylinder liner 34', opening bores 94 and allowing the fluid in the piston chamber 72' to be forced out into the outlet passage 32'.

As will be readily apparent, the above described preferred embodiments of the present invention provide a pump structure which is considerably easier to assemble and properly adjust than those previously known, thereby minimizing manufacturing costs. Repair also is easier since a single valve/piston cartridge, or even just a cartridge liner, can be easily be replaced upon failure.

While the invention has been described in conjunction with certain specific embodiments, it is to be understood that many alternatives, modifications and variations will be apparent to those skilled in the art in light of the aforegoing description. For example, the first preferred embodiment could easily be modified to have the outlet valve rather than the inlet valve in the cartridge simply by eliminating or reversing the angling of the base 84 of the valve sleeve 70 and by reversing the direction in which check valve 86 operates. Similarly, the positions of the inlet and outlet valves in the second preferred embodiment can easily be reversed by reversing which flexible member 98, 100 is inside liner 90 and which is outside. One flexible member 98, 100 could even be eliminated and an external check valve such as check valve 86 substituted nstead. Accordingly, this invention is intended to embrace all such alternatives, modifications and variations which fall within the spirit and scope of the appended claims.

We claim:

1. A rotary piston pump comprising:

a pump housing;

a rotor rotatably mounted in said housing by a plurality of bearings and having an eccentric piston-actuating cam surface thereon;

a plurality of radially extending pistons actuable by said cam surface; and an end quill threadedly engaged with said housing and pressing against a race of at least one of said bearings, a preload on said bearings being adjustable by adjusting the threaded engagement position of said end quill with said housing.

2. The rotary piston pump of claim 1, further comprising at least one lock nut for holding said end quill in a desired threaded engagement position.

3. The rotary piston pump of claim 1, further comprising at least one counterweight on said rotor for compensating for the eccentricity of said cam surface to dynamically balance said rotor.

4. The rotary piston pump of claim 1, further comprising:

a plurality of radially extending valve/piston cartridge receiving bores formed in said housing and circumferentially spaced about said cam surface; and a plurality of valve/piston cartridges, one of said pistons being disposed in each said cartridge and each said cartridge being disposed in one of said cartridge bores.

5. The rotary piston pump of claim 4, further comprising an inlet passage and an outlet passage formed in said housing and opening into each said cartridge bore.

6. The rotary piston pump of claim 5, wherein each said cartridge further comprises:

a hollow liner positioned within the corresponding cartridge bore, with the corresponding piston slidably positioned within said liner;

an end cap for holding said liner in said cartridge bore; and valve means positioned within said liner, with said piston, liner, end cap and valve means defining a piston chamber therebetween, and said valve means regulating fluid flow between said piston chamber and one of said inlet and outlet passages.

* * * * *